US009530533B2

(12) United States Patent
Orita

(10) Patent No.: US 9,530,533 B2
(45) Date of Patent: Dec. 27, 2016

(54) CONDUCTIVE PASTE COMPOSITION

(71) Applicant: HONDA MOTOR CO., LTD., Tokyo (JP)

(72) Inventor: Atsuo Orita, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/724,213

(22) Filed: May 28, 2015

(65) Prior Publication Data

US 2016/0351289 A1 Dec. 1, 2016

(51) Int. Cl.
*H01B 1/22* (2006.01)

(52) U.S. Cl.
CPC ..... *H01B 1/22* (2013.01)

(58) Field of Classification Search
CPC ..... H01B 1/22
USPC ..... 252/500
See application file for complete search history.

(56) References Cited

U.S. PATENT DOCUMENTS

2012/0245272 A1* 9/2012 Dent ..... C08L 83/14 524/502
2014/0099537 A1* 4/2014 Kato ..... H01M 4/667 429/210

FOREIGN PATENT DOCUMENTS

JP 2003-174205 6/2003
JP 5486268 2/2014

* cited by examiner

*Primary Examiner* — Mark Kopec
*Assistant Examiner* — Danny N Kang
(74) *Attorney, Agent, or Firm* — Rankin, Hill & Clark LLP

(57) ABSTRACT

Provided is an inexpensive conductive paste composition capable of forming an electrode having a sufficient expansion and contraction property and conductivity as an membrane electrode for use in an electrostrictive element. The conductive paste composition comprises an electrode-forming component, and a solvent in an amount of 10% to 70% by mass with respect to the electrode-forming component. The electrode-forming component comprises, with respect to the total amount of the solids content of the electrode-forming component, 2.5% to 4.7% by mass of a conductive carbon material, 54% to 68% by mass of silicone rubber, 0.05% to 0.2% by mass of a curing catalyst composed of a platinum-siloxane complex, and 16% to 30% by mass of silica.

5 Claims, 1 Drawing Sheet

CONDUCTIVE PASTE COMPOSITION

BACKGROUND OF THE INVENTION

Field of the Invention

The present invention relates to a conductive paste composition for use in forming and the like a membrane electrode of an electrostrictive element.

Description of the Related Art

It is known that when electrodes are connected to both front and back surfaces of a dielectric film formed of an elastomer and a voltage is applied, a compressive force is given to the dielectric film by Maxwell stress (piezoelectric adverse effect) from the interfacial polarization brought about by static electricity, and the dielectric film contracts in the thickness direction and expands in the lateral direction (the direction orthogonal to the thickness direction). In recent years, an electrostrictive element comprising a dielectric film and electrodes, which is driven by the aforementioned principle, is studied.

As the electrostrictive element, an electrostrictive element having a dielectric film formed of an elastomer, membrane electrodes arranged on both front and back surfaces of the inner side of the peripheral edge of the dielectric film and capable of expansion and contraction following the expansion and contraction of the dielectric film, a rim-type frame arranged on the peripheral edge of one surface of the dielectric film for retaining the dielectric film in an expanding state, and an electricity collector connected to the peripheral edge of the membrane electrodes has been proposed (refer to, for example, Patent Document 1: Japanese Patent Laid-Open No. 2003-174205).

When a positive or negative voltage is applied to each membrane electrode via the electricity collector, the dielectric film of the electrostrictive element contracts in the thickness direction and expands in the lateral direction, but the dielectric film is restricted in expanding toward the outer side and expands toward the inner side, and protrudes toward one surface side to thereby form nearly a mountain-like shape as a whole, since the peripheral edge of the aforementioned dielectric film is retained by the rim-type frame. And, the membrane electrode expands following the behavior of the dielectric film so as to expand and is changed in its shape to nearly a mountain-like shape.

After that, the shape of the expanded dielectric film is almost restored to the original shape by release of the application of voltage, and the expanded membrane electrode is almost restored to the original shape following the behavior of restoration of the dielectric film.

The membrane electrode for use in the electrostrictive element is required to be capable of expansion and contraction following the transformation of the dielectric film formed of an elastomer. In addition to the capabilities of expansion and contraction, the membrane electrode is also required to be small in variation of electrical resistance when expanded.

There is such a problem that when the membrane electrode is formed with a conductive paste such as a silver paste containing silver powder compounded in a binder resin, the formed membrane electrode is short of flexibility and cracks are generated when it is expanded in a large degree, as a result, electrical resistance conspicuously increases. There is also another problem such that the membrane electrode formed with the above conductive paste cannot follow expansion and contraction of the aforementioned dielectric film and hinders the movement of the dielectric film.

For solving the above problems, it is known to form the membrane electrode with a conductive paste obtained by dissolving an elastomer having a functional group capable of hydrogen bonding and a glass transition temperature (Tg) of −10° C. or less in a solvent, and adding a flaky or acicular first metal filler and a lumpy second metal filler to the above solution (refer to, for example, Patent Document 2: Japanese Patent No. 5486268).

However, the conductive paste described in Patent Document 2 has such a disadvantage that when a membrane electrode for use in an electrostrictive element is formed, it is sometimes difficult to simultaneously satisfy sufficient expansion and contraction property, and conductivity, further, a shape retaining property, a thin film property, and durability.

Accordingly, an object of the present invention is to solve such a disadvantage and provide a conductive paste composition that is capable of forming an electrode having sufficient expansion and contraction property, and conductivity as the membrane electrode for use in an electrostrictive element in a dried state as a thin film and that is also inexpensive.

SUMMARY OF THE INVENTION

For attaining such an object, the conductive paste composition of the present invention is a conductive paste composition comprising an electrode-forming component, and a solvent in an amount of 10% to 70% by mass with respect to the electrode-forming component, wherein the electrode-forming component comprises, with respect to a total amount of solids content, 2.5% to 4.7% by mass of a conductive carbon material, 54% to 68% by mass of silicone rubber, 0.05% to 0.2% by mass of a curing catalyst of a platinum-siloxane complex, and 16% to 30% by mass of silica.

When the conductive paste composition of the present invention contains a conductive carbon material in an amount of 2.5% to 4.7% by mass based on the total amount of the solids content of the electrode-forming component, conductivity of, for example, $10^2$ Ωcm or less can be obtained, which is sufficient conductivity as the membrane electrode for use in an electrostrictive element. When the amount of the conductive carbon material is less than 2.5% by mass with respect to the total amount of the solids content of the electrode-forming component, conductivity required as the membrane electrode for use in an electrostrictive element cannot be obtained. While when the amount of the conductive carbon material is more than 4.7% by mass with respect to the total amount of the solids content of the electrode-forming component, expansion and contraction property required as the membrane electrode for use in an electrostrictive element cannot be obtained, since the conductive carbon becomes dominant for composite material property.

Further, when the conductive paste composition of the present invention contains silicone rubber in an amount of 54% to 68% by mass with respect to the total amount of the solids content of the electrode-forming component, a sufficient expansion and contraction property as the membrane electrode for use in an electrostrictive element can be obtained, for example, expansion at the breaking point of 150% or more of the original dimension. When the amount of the silicone rubber is less than 54% by mass with respect to the total amount of the solids content of the electrode-forming component, expansion and contraction property required as the membrane electrode for use in an electrostrictive element cannot be obtained. While when the amount of the silicone rubber is more than 68% by mass with respect to the total amount of the solids content of the electrode-forming component, the silicone rubber cannot be cured when the conductive paste composition is dried.

Furthermore, when the conductive paste composition of the present invention contains a curing catalyst of a platinum-siloxane complex in an amount of 0.05% to 0.2% by mass with respect to the total amount of the solids content of the electrode-forming component, the silicone rubber can be cured when the conductive paste composition is dried. When the amount of the curing catalyst is less than 0.05% by mass with respect to the total amount of the solids content of the electrode-forming component, the silicone rubber cannot be cured. When the amount of the curing catalyst is more than 0.2% by mass with respect to the total amount of the solids content of the electrode-forming component, the silicone rubber is excessively cured or residual impurities increase after curing, and thus expansion and contraction property required as the membrane electrode for use in an electrostrictive element cannot be obtained.

Moreover, when the conductive paste composition of the invention contains silica in an amount of 16% to 30% by mass with respect to the total amount of the solids content of the electrode-forming component, the conductive paste composition can be manufactured inexpensively. When the amount of the silica is less than 16% by mass with respect to the total amount of the solids content of the electrode-forming component, the effect of inexpensively manufacturing the conductive paste composition cannot be obtained. When the amount of the silica is more than 30% by mass with respect to the total amount of the solids content of the electrode-forming component, expansion and contraction property or conductivity required as the membrane electrode for use in an electrostrictive element cannot be obtained.

In addition, when the conductive paste composition of the invention contains a solvent in an amount of 10% to 70% by mass based on the amount of the electrode-forming component, a membrane electrode for use in an electrostrictive element can be formed. When the amount of the solvent is less than 10% by mass based on the amount of the electrode-forming component, the conductive paste composition cannot be applied. When the amount of the solvent is more than 70% by mass based on the amount of the electrode-forming component, the amount of the electrode-forming component to be dissolved in the solvent increases, and thus expansion and contraction property or conductivity required as the membrane electrode for use in an electrostrictive element cannot be obtained.

In the conductive paste composition of the present invention, as the conductive carbon material, at least one conductive carbon material selected from a group consisting of acetylene black, ketchen black, oil furnace black, a conductive single-wall carbon nanotube, and a conductive multi-wall carbon nanotube can be used.

In the conductive paste composition of the invention, as the silicone rubber, one silicone rubber selected from a group consisting of methyl silicone rubber, vinyl methyl silicone rubber, and phenyl methyl silicone rubber can be used.

In the conductive paste composition of the present invention, as the platinum-siloxane complex, a platinum-carbonyl cyclovinylmethylsiloxane complex (CAS No. 73018-55-0) or a platinum(0)-1,3-divinyl-1,1,3,3-tetramethyldisiloxane complex CAS No. 68478-92-2) can be used.

In the conductive paste composition of the present invention, as the solvent, at least one solvent selected from a group consisting of toluene, benzene, hexane, methanol, ethanol, isopropanol, gasoline, light oil, and ethyl acetate can be used.

DETAILED DESCRIPTION OF THE PREFERRED EMBODIMENTS

Figure 1A:
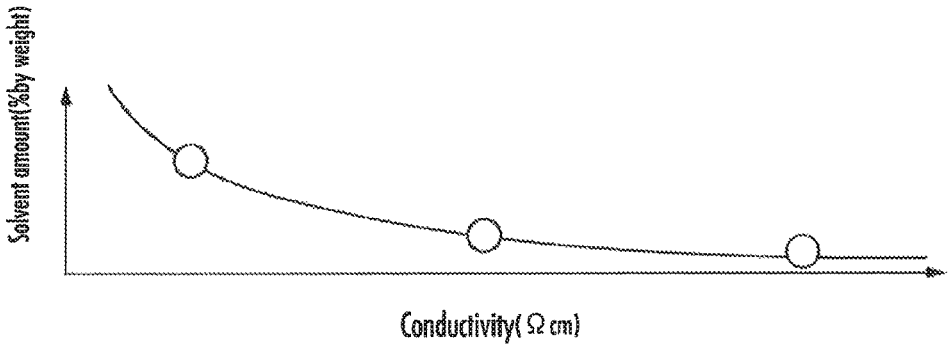
FIG. 1A is a graph showing the relationship between an amount of solvent in a conductive paste composition of the present invention and a conductivity of a membrane electrode to be formed.

The embodiments of the present invention will be described in further detail.

The conductive paste composition of the present embodiment is a conductive paste composition comprising an electrode-forming component, and a solvent in an amount of 10% to 70% by mass with respect to the electrode-forming component, wherein the electrode-forming component comprises, with respect to the total amount of the solids content, 2.5% to 4.7% by mass of a conductive carbon material, 54% to 68% by mass of silicone rubber, 0.05% to 0.2% by mass of a curing catalyst of a platinum-siloxane complex, and 16% to 30% by mass of silica.

As the conductive carbon material constituting the electrode-forming component, for example, carbon black, such as acetylene black, ketchen black, or oil furnace black, a conductive carbon nanotube, such as a conductive single-wall carbon nanotube or a conductive multi-wall carbon nanotube can be used. These conductive carbon materials can be used in one kind alone, or two or more materials can be used as a mixture.

As the silicone rubber constituting the electrode-forming component, for example, any one of methyl silicone rubber, vinyl methyl silicone rubber, and phenyl methyl silicone rubber or the like can be used.

The curing catalyst constituting the electrode-forming component is a catalyst for curing the silicone rubber when the conductive paste composition in the embodiment is dried, and, for example, a platinum-carbonyl cyclovinylmethylsiloxane complex (CAS No. 73018-55-0) or a platinum (0)-1,3-divinyl-1,1,3,3-tetramethyldisiloxane complex CAS No. 68478-92-2) can be used.

As the curing catalyst, any one of the above platinum-siloxane complexes can be used alone, or both can be used as a mixture.

As the solvent, any solvent can be used so long as it is a solvent capable of dissolving the silicone rubber, and, for example, aromatic solvents, such as toluene, benzene and hexane, alcohol solvents, such as methanol, ethanol, and isopropanol, aliphatic solvents, such as gasoline and light oil, and ester solvents, such as ethyl acetate can be used. The solvent can be used in one kind alone, or two or more solvents can be used as a mixture.

The conductive paste composition in the embodiment can be prepared by adding each of the above-prescribed amount of the conductive carbon material, the silicone rubber, the curing catalyst of the platinum-siloxane complex, and the silica to the above-prescribed amount of the solvent, and stirring them. Stirring can be carried out with a well-known apparatus, for example, a ball mill, a roll mill, a stirrer, or an rotation or revolution stirring apparatus, and a well-known method.

A membrane electrode can be formed by applying the conductive paste composition in the embodiment on an elastomer dielectric substance constituting an electrostrictive element and drying. As the elastomer dielectric substances, for example, films composed of acrylic resins can be used. Application of the conductive paste composition in the embodiment can be carried out with a well-known method, such as screen printing, spin coating, a film applicator, inkjet, or a spray gun.

As a result, according to the conductive paste composition in the embodiment, a membrane electrode having conductivity of $10^2$ Ωcm or less and an expansion and contraction property showing expansion of at least 150% or more of the original dimension until the breaking point can be formed on the surface of the elastomer dielectric substance.

The examples of the invention are shown below.

EXAMPLES

Example 1

In Example 1, 11.1 g of isopropanol (WA) was put in a vessel as the solvent, 100 g of an electrode-forming component was added thereto, and they were stiffed with a mortar to produce a conductive paste composition. The conductive paste composition obtained in Example 1 contains 10% by mass of the solvent with respect to the electrode-forming component.

In the conductive paste composition obtained in Example 1, the electrode-forming component contains, with respect to the total amount of the solids content, 2.5% by mass of carbon black, 55% by mass of vinyl methyl silicone rubber, 0.05% by mass of a platinum-siloxane complex (a curing catalyst), and 30% by mass of silica.

Next, a membrane electrode having a prescribed pattern was formed by screen-printing the conductive paste composition obtained in Example 1 on the surface of an elastomer dielectric substance (manufactured by 3M, trade name: VHB4910), and drying by maintaining the printed elastomer dielectric substance at 40° C. for at least 1 hour or more.

After that, conductivity of the membrane electrode was determined by measuring the resistance between certain spaces. Further, expansion of the membrane electrode from the original dimension up to the breaking point was determined by single tensile length measurement of films having a constant shape. The membrane electrode showed conductivity of 100 Ωcm, and an expansion and contraction property showing expansion up to the breaking point of 200% or more of the original dimension. The results obtained are shown in Table 1 and FIG. 1 below.

Example 2

In Example 2, 53.9 g of IPA was put in a vessel as the solvent, 100 g of an electrode-forming component was added thereto, and they were stirred with a mortar to produce a conductive paste composition. The conductive paste composition obtained in Example 2 contains 35% by mass of the solvent with respect to the electrode-forming component.

In the conductive paste composition obtained in Example 2, the electrode-forming component contains, with respect to the total amount of the solids content, 4.7% by mass of carbon black, 51% by mass of vinyl methyl silicone rubber, 0.17% by mass of a platinum-siloxane complex (a curing catalyst), and 28.8% by mass of silica.

Next, a membrane electrode having a prescribed pattern was formed in completely the same manner as in Example 1 except for using the conductive paste composition obtained in Example 2.

After that, conductivity and expansion from the original dimension up to the breaking point of the membrane electrode were determined in completely the same manner as in Example 1. The membrane electrode showed conductivity of 10 Ωcm, and an expansion and contraction property showing expansion at the breaking point of 150% of the original dimension. The results obtained are shown in Table 1 and FIG. 1.

Example 3

In Example 3, 233 g of IPA was put in a vessel as the solvent, 100 g of an electrode-forming component was added thereto, and they were stirred with a mortar to produce a conductive paste composition. The conductive paste composition obtained in Example 3 contains 70% by mass of the solvent with respect to the electrode-forming component.

In the conductive paste composition obtained in Example 3, the electrode-forming component comprises, with respect to the total amount of the solids content, 4.7% by mass of carbon black, 66% by mass of vinyl methyl silicone rubber, 0.17% by mass of a platinum-siloxane complex (a curing catalyst), and 16.4% by mass of silica.

Next, a membrane electrode having a prescribed pattern was formed in completely the same manner as in Example 1 except for using the conductive paste composition obtained in Example 3.

After that, conductivity and expansion from the original dimension at the breaking point of the membrane electrode were determined in completely the same manner as in Example 1. The membrane electrode showed conductivity of 10 Ωcm, and an expansion and contraction property showing expansion at the breaking point of 150% or more of the original dimension. The results obtained are shown in Table 1 and FIG. 1.

TABLE 1

| | | | Example 1 | Example 2 | Example 3 |
|---|---|---|---|---|---|
| Electrode-forming component | Carbon black | (% by mass) | 2.5 | 4.7 | 4.7 |
| | Silicone rubber | (% by mass) | 55 | 51 | 66 |
| | Platinum-siloxane complex | (% by mass) | 0.05 | 0.17 | 0.17 |
| | Silica | (% by mass) | 30 | 28.8 | 16.4 |
| Solvent | Isopropanol | (% by mass) | 10 | 35 | 35 |
| Conductivity | | (Ω cm) | 100 | 10 | 10 |
| Expansion and contraction property | | (%) | 200 | 150 | 150 |

Figure 1B:
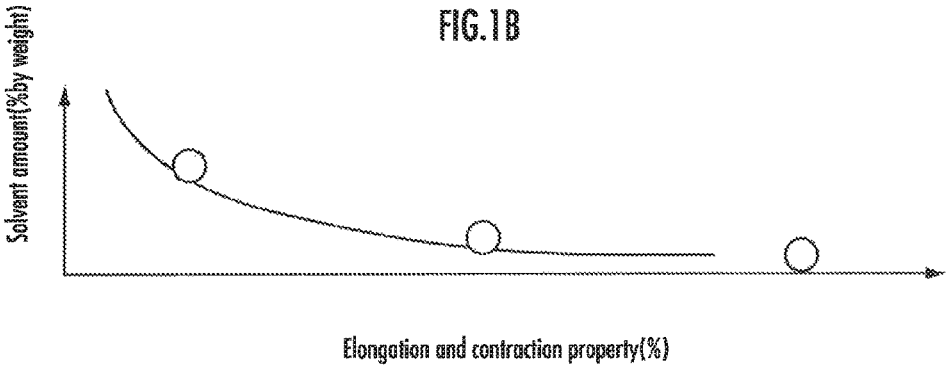
FIG. 1B is a graph showing the relationship between the amount of the solvent in the conductive paste composition of the present invention and the expansion and contraction property of the membrane electrode to be formed.

From Table 1 and FIG. 1, it is apparent that by using the conductive paste compositions of the present invention, membrane electrodes having conductivity of $10^2$ Ωcm or less and an expansion and contraction property showing expansion at the breaking point of 150% or more of the original dimension can be formed.

What is claimed is:

1. A conductive paste composition comprising an electrode-forming component, and a solvent in an amount of 10% to 70% by mass with respect to the electrode-forming component, wherein the electrode-forming component comprises, with respect to a total amount of the solids content of the electrode-forming component, 2.5% to 4.7% by mass of a conductive carbon material, 54% to 68% by mass of silicone rubber, 0.05% to 0.2% by mass of a curing catalyst composed of a platinum-siloxane complex, and 16% to 30% by mass of silica.

2. The conductive paste composition according to claim 1, wherein the conductive carbon material is at least one conductive carbon material selected from a group consisting of acetylene black, ketchen black, oil furnace black, a conductive single-wall carbon nanotube, and a conductive multi-wall carbon nanotube.

3. The conductive paste composition according to claim 1, wherein the silicone rubber is one silicone rubber selected from a group consisting of methyl silicone rubber, vinyl methyl silicone rubber, and phenyl methyl silicone rubber.

4. The conductive paste composition according to claim 1, wherein the platinum-siloxane complex is a platinum carbonyl cyclovinylmethylsiloxane complex or a platinum(0)-1,3-divinyl-1,1,3,3-tetramethyldisiloxane complex.

5. The conductive paste composition according to claim 1, wherein the solvent is at least one solvent selected from a group consisting of toluene, benzene, hexane, methanol, ethanol, isopropanol, gasoline, light oil, and ethyl acetate.

* * * * *